US005895103A

United States Patent [19]

Huber

[11] Patent Number: 5,895,103

[45] Date of Patent: Apr. 20, 1999

[54] FASTENING DEVICE FOR A FRONT PLATE OF A DRAWER

[75] Inventor: Edgar Huber, Hard, Austria

[73] Assignee: Julius Blum Gesellschaft m.b.H., Höchst, Austria

[21] Appl. No.: 08/860,493

[22] PCT Filed: Oct. 11, 1996

[86] PCT No.: PCT/AT96/00195

§ 371 Date: Jun. 30, 1997

§ 102(e) Date: Jun. 30, 1997

[87] PCT Pub. No.: WO97/16090

PCT Pub. Date: May 9, 1997

[30] Foreign Application Priority Data

Oct. 30, 1995 [AT] Austria ..... 1789/95

[51] Int. Cl.[6] ..... A47B 88/00

[52] U.S. Cl. ..... 312/348.4; 403/230; 403/409.1

[58] Field of Search ..... 312/348.4, 348.2, 312/348.1, 263; 403/230, 409.1, 231

[56] References Cited

U.S. PATENT DOCUMENTS

| | | | |
|---|---|---|---|
| 5,364,181 | 11/1994 | Scheible | 312/348.4 |
| 5,611,637 | 3/1997 | Brustle et al. | 312/348.4 |

FOREIGN PATENT DOCUMENTS

| | | | |
|---|---|---|---|
| 391 987 | 12/1990 | Austria . | |
| 289866 | 11/1988 | European Pat. Off. | 312/348.4 |
| 0 698 357 | 2/1996 | European Pat. Off. . | |
| 26 10 200 | 5/1979 | Germany . | |
| 26 25 182 | 10/1979 | Germany . | |
| 3416627 | 11/1985 | Germany | 312/348.4 |
| 36 43 312 | 6/1988 | Germany . | |
| 3801103 | 8/1988 | Germany | 312/348.4 |
| 38 01 195 | 7/1989 | Germany . | |

*Primary Examiner*—Peter M. Cuomo
*Assistant Examiner*—James O. Hansen
*Attorney, Agent, or Firm*—Wenderoth, Lind & Ponack, L.L.P.

[57] ABSTRACT

A device for fastening a front plate of a drawer to a drawer side wall includes a flange, at least one expandable dowel to be inserted into a hole in the front plate, the dowel being separate from and not integral with the flange, and an expanding member positioned within the dowel and movable therein between an expanding position and a release position, the expanding member having an end extending from the dowel. The dowel and the expanding member are positioned on a first side of the flange to face the front plate, with the end of the expanding member passing through an aperture in the flange. A tensioning lever is positioned at a second side of the flange directed away from the front plate and is pivotally connected to the end of the expanding member for pivoting movement between a released position and a tensioning position. The tensioning lever has a cam operable to act on the flange when the tensioning lever is pivoted to the tensioning position, thus to pull the expanding member relative to the dowel to expand the dowel outwardly and to clamp the flange between the dowel and the cam.

30 Claims, 11 Drawing Sheets

FASTENING DEVICE FOR A FRONT PLATE OF A DRAWER

BACKGROUND AND SUMMARY OF THE INVENTION

The invention relates to a fastening device for fastening a front plate of a drawer to metal drawer side walls or plastic drawer side walls, whereby the front plate may be of wooden material. The fastening device includes dowels which are insertable into holes in the front plate and are fastenable therein by means of clamping devices. The drawer side walls have at their front ends apertured flanges extending parallel to the front plate and on which the fastening devices are fixable.

It is an object of the invention to provide a rapid fastening of the front plate especially on metal drawer side walls. It is a further object of the invention to provide such a fastening device with a so-called zero position. This means that the front plate will always be fastened to the drawer side walls in a given position. In most cases the position is correct and extensive positioning of the front plate with respect to the drawer side walls is not necessary. If necessary, it is possible to provide an adjustment with respect to the height and/or the side of the drawer.

These objects of the invention are achieved in that the fastening device comprises at least one tensioning lever which is hinged to expanding members situated within the dowels and which extend through the holes in the flanges. The expanding members are movable into the expanding positions or release positions by tilting of the tension lever. The dowels are positioned at the side of the flange directed to the front plate and the tensioning lever is positioned at the side of the flange directed away from the front plate.

In an embodiment of the invention in which a zero position is provided, the expanding members are at least partially cylindrical with a reduction which is situated at the flange when the tensioning lever is not in the release position. When the tensioning lever is in the release position, a part of each expanding member adjacent to the reduction is held without clearance between rims of a respective hole. If the tensioning lever is in the release position, the expanding member is held between the rims of the hole without clearance, and displacement to the side is not possible. If the tensioning lever is pivoted by approximately 30° toward the drawer side wall, then the expanding member is pulled so far that the reduction is situated within the hole so that a displacement to the side is possible. At this point the expanding member with the dowel is not clamped so much that a displacement would not be possible. When the tensioning lever reaches its final locking position, that is it lies at the side of the drawer side wall. The expanding member with the dowel is fixed to the flange of the drawer side wall by the clamping force of the tensioning lever.

In a further embodiment of the invention, the tensioning lever is provided with a lateral projection which in the release position projects into a hole in the flange of the drawer side wall. Such a projection locks the fastening device with respect to the height of drawer and provides a zero position in this regard. If the tensioning lever is in a position between the release position and the expanding position, then the projection does not project into the hole in the flange of the drawer side wall and the fastening device together with the front plate can be displaced in the direction of the height of the drawer side wall.

A further embodiment of the invention provides that two tensioning levers are provided on each drawer side wall, whereby the axes around which the tensioning levers are tiltable are aligned horizontally and that the tensioning levers are arranged one above the other. With this embodiment there is again provided that at least one of the tensioning levers is provided at its end situated at the axle with a projection or the like which projects into a vertical slot in the flange and/or the intermediate plate. In this way a zero position is provided for the front plate, when the tensioning lever is pushed downwardly the projection is moved out of the slot and the front plate is laterally displaceable with respect to the side walls of the drawer.

Advantageously, the flanges are formed on angled brackets which are fastened to the drawer side walls, for example clamped by means of screws. When the screw extends through a vertical slot in the drawer side wall or in the angled bracket height displacement of the front plate is possible.

BRIEF DESCRIPTION OF THE DRAWINGS

In the following two embodiments of the invention are described in detail with reference to the accompanying drawings, wherein:

FIG. 4 is an enlarged view of detail B of FIG. 3;

Figures 1, 2:
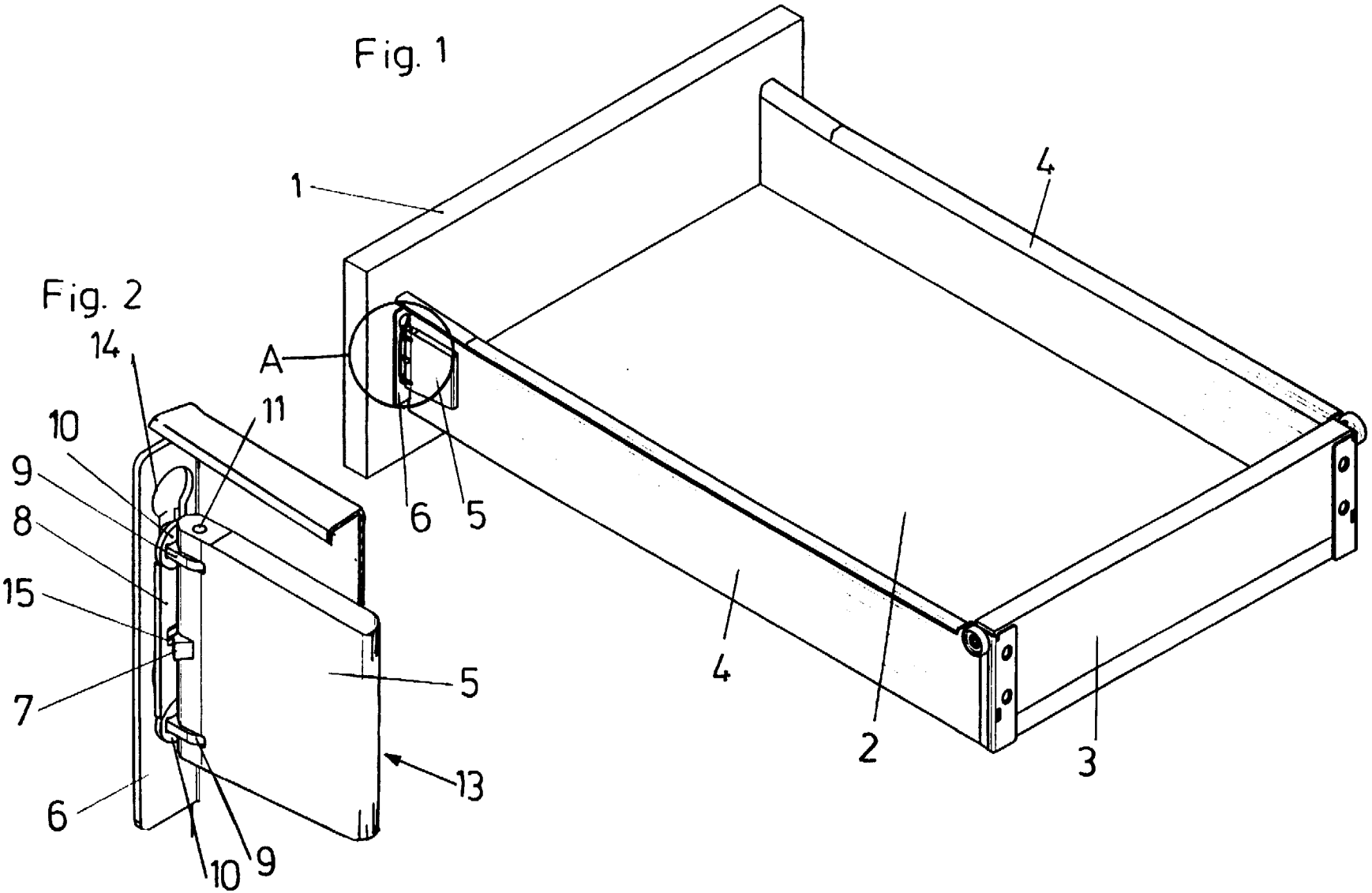
FIG. 1 is a perspective view of a drawer with a mounted frog plate.
FIG. 2 is an enlarged view of detail A of FIG. 1.
Figure 3:
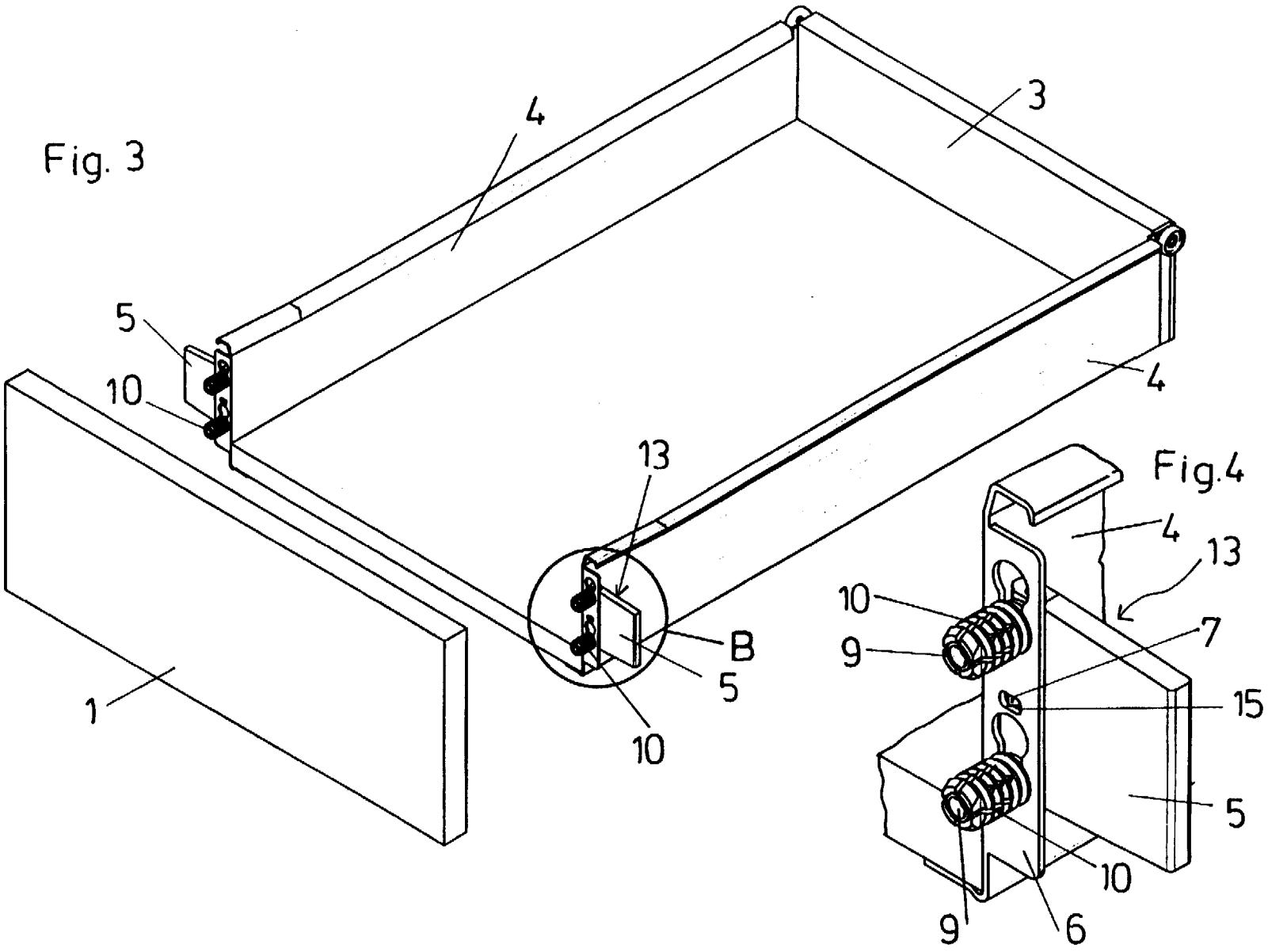
FIG. 3 is a perspective view of the drawer before the front plate is mounted.
Figure 5:
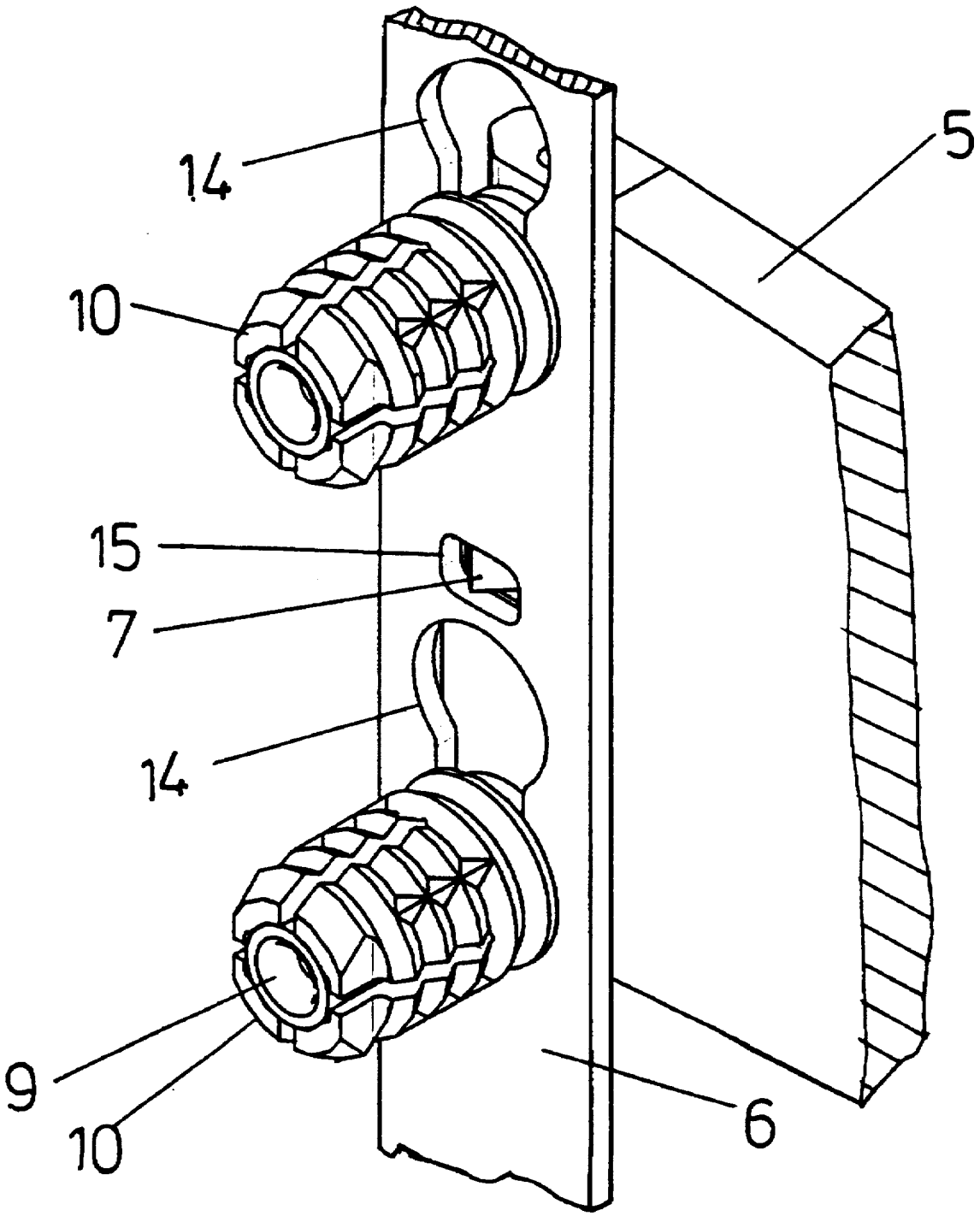
FIG. 5 is an enlarged view of a fastening device and a front flange of a drawer side wall.

DETAILED DESCRIPTION OF THE INVENTION a drawer includes a front plate 1, drawer bottom 2, rear wall 3 and two drawer side walls 4. The front plate 1 is fastened to each of the drawer side walls 4 by means of fastening devices 13 according to the invention.

Figure 6:
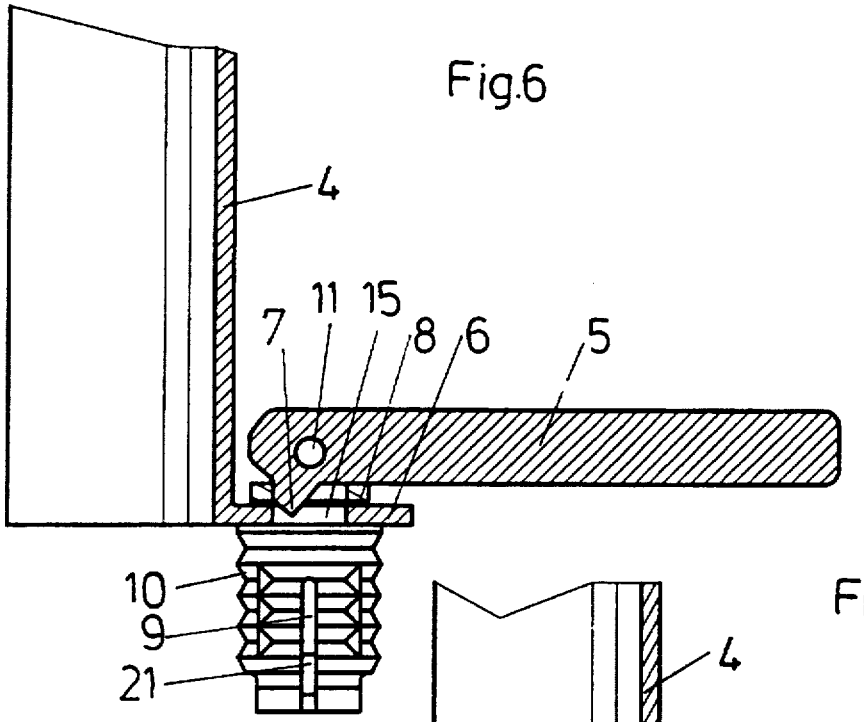
FIG. 6 is a sectional view thorough the front part of the drawer side wall and the fastening device in the area of a projection in a fully released position.
Figure 7:
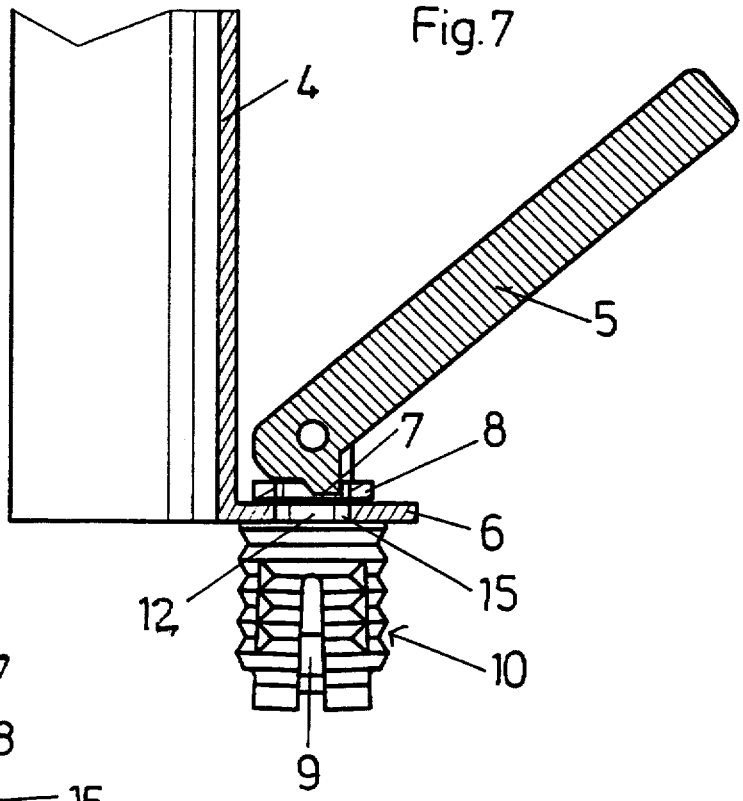
FIG. 7 is the same sectional view as the FIG. 6 but showing a tensioning lever in a middle position.
Figure 8:
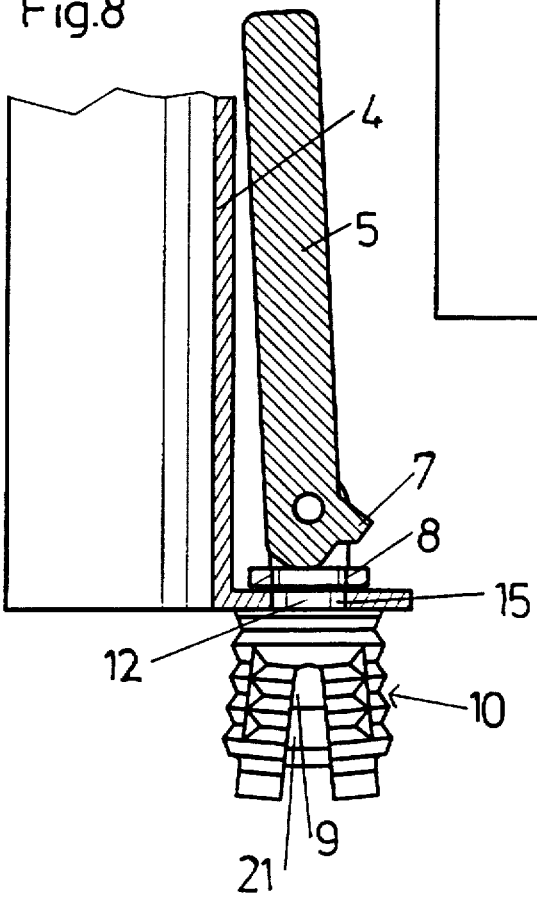
FIG. 8 is the same view as FIGS. 6 and 7 but showing the tensioning lever in a clamping position.

In the embodiment according to FIG. 1 to 11 front ends of the drawer side walls 4 are provided with respective flanges 6 protruding at a right angle. Each flange 6 has two keyhole slots 14 and a rectangular hole 15 situated between the keyhole slots 14. Dowels 10 with respective expanding members 9 are suspended in respective keyhole slots 14. A tensioning lever 5 is supported by axles 11 on the two expanding members 9. A metal intermediate plate 8 is situated between the tensioning lever 5 and the flange 6. A cam 16 of the tensioning lever 5 abuts intermediate plate 8 in a clamping position. The tensioning lever 5 is provided with a projection 7, particularly shown in FIG. 2, which acts as a centering means for a non-clamped or zero position, e.g. as shown in FIG. 6.

When mounting the front plate the fastening devices 13 are anchored in the flange 6 of the drawer side walls 4 by the dowels 10 so that at least the expandable parts of the dowels are positioned in front of the flanges 6 and the tensioning levers 5 are positioned behind the flanges 6. Projection 7 at the front end of each tensioning lever 5 projects into a respective hole 15 in flange 6 as shown in FIG. 6. Tensioning levers 5 are in the released positions. In this way the fastening device and subsequently front plate 1 are held in a zero position. If the tensioning lever 5 is tilted or pivoted about axle 11 toward the drawer side wall and is situated in the intermediate position shown in FIG. 7, then the projection 7 no longer projects into the hole 15, and the fastening device 13 together with the front plate 1 can be displaced upwardly or downwardly relative to the drawer side wall. In the clamping position shown in FIG. 11 in which the tensioning lever 5 is aligned parallel to the drawer side wall 4, the cam 16 presses onto the intermediate plate 8 and therefore on the flange 6 of the drawer side wall 4 with such force that displacement of the front plate 1 no longer is possible. Each expanding member 9 is provided with a reduction 12 which makes lateral displacement possible.

Figure 9:
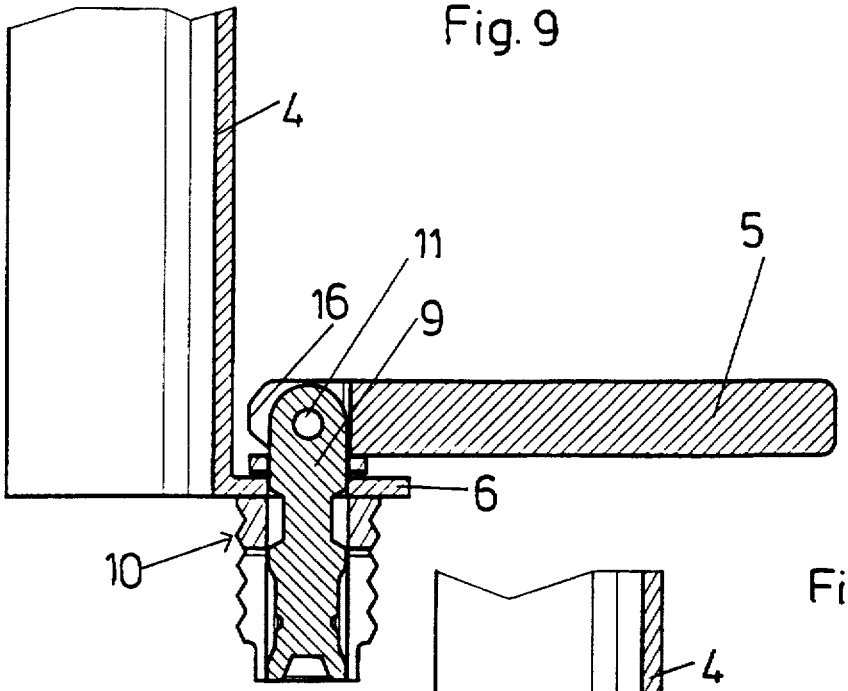
FIGS. 9 to 11 are sectional views similar to FIGS. 6–8 but also sectioned through an expanding member.
Figure 10:
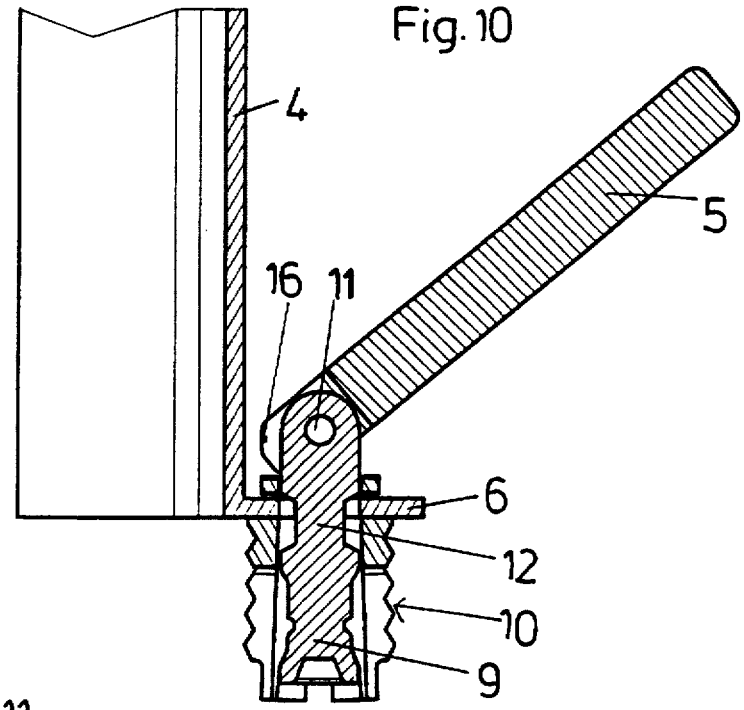
Figure 11:
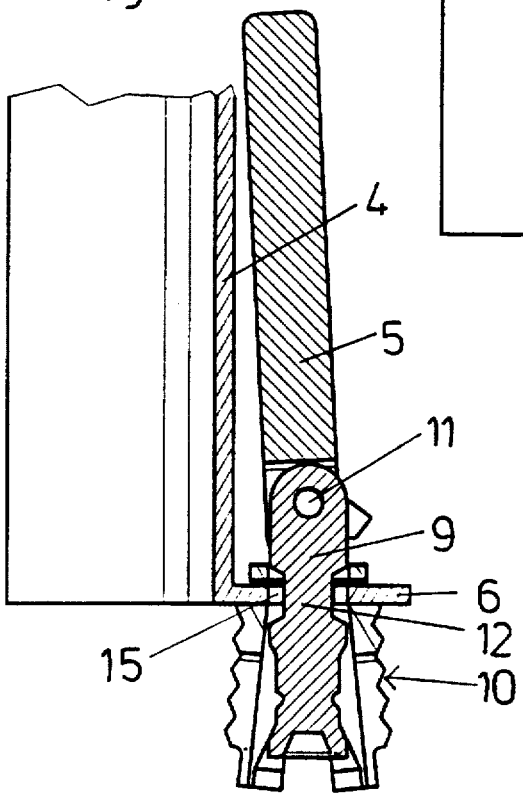
Figure 12:
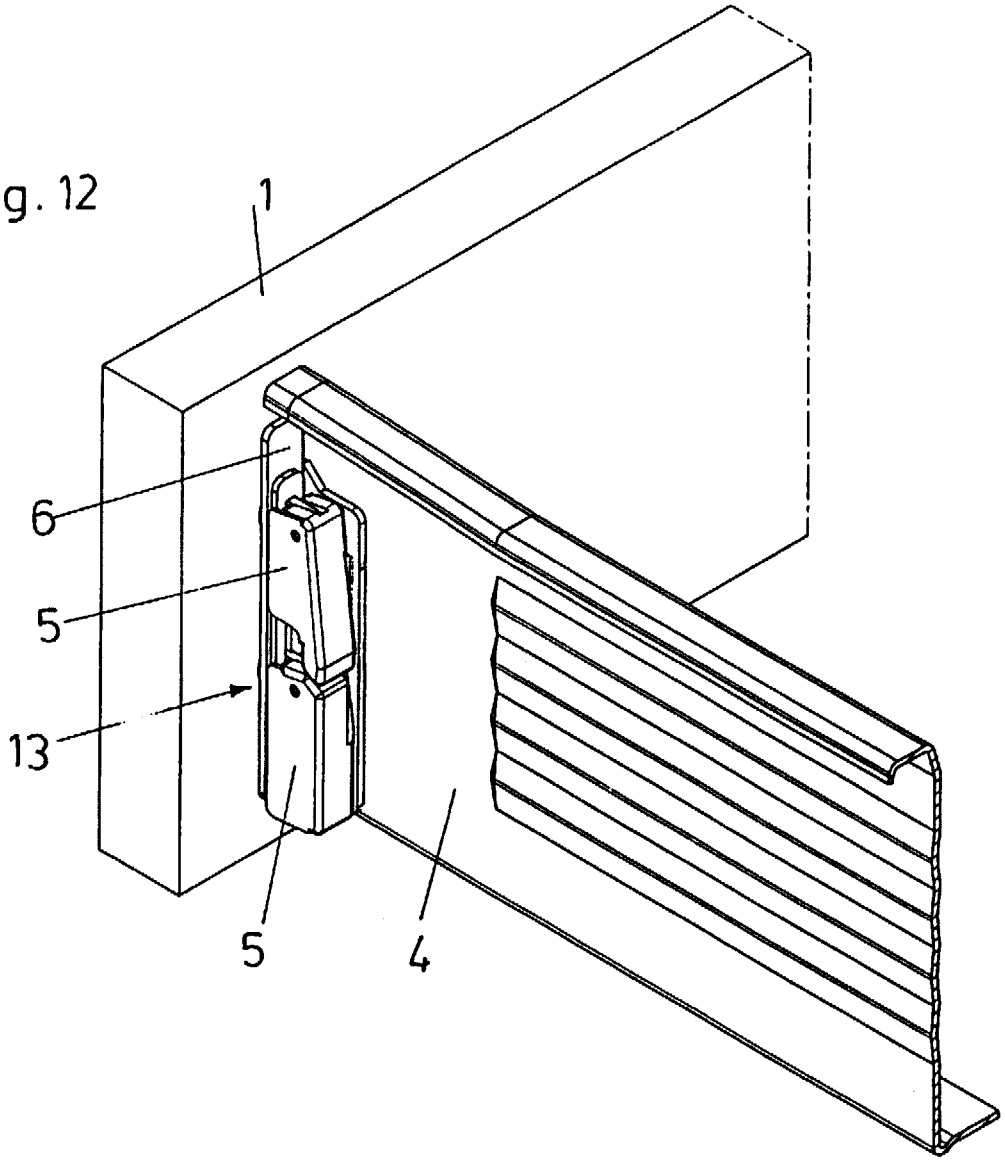
FIG. 12 is a perspective view of a further embodiment of the fastening device according to the invention showing a front plate fastened to a drawer side wall.
Figure 13:
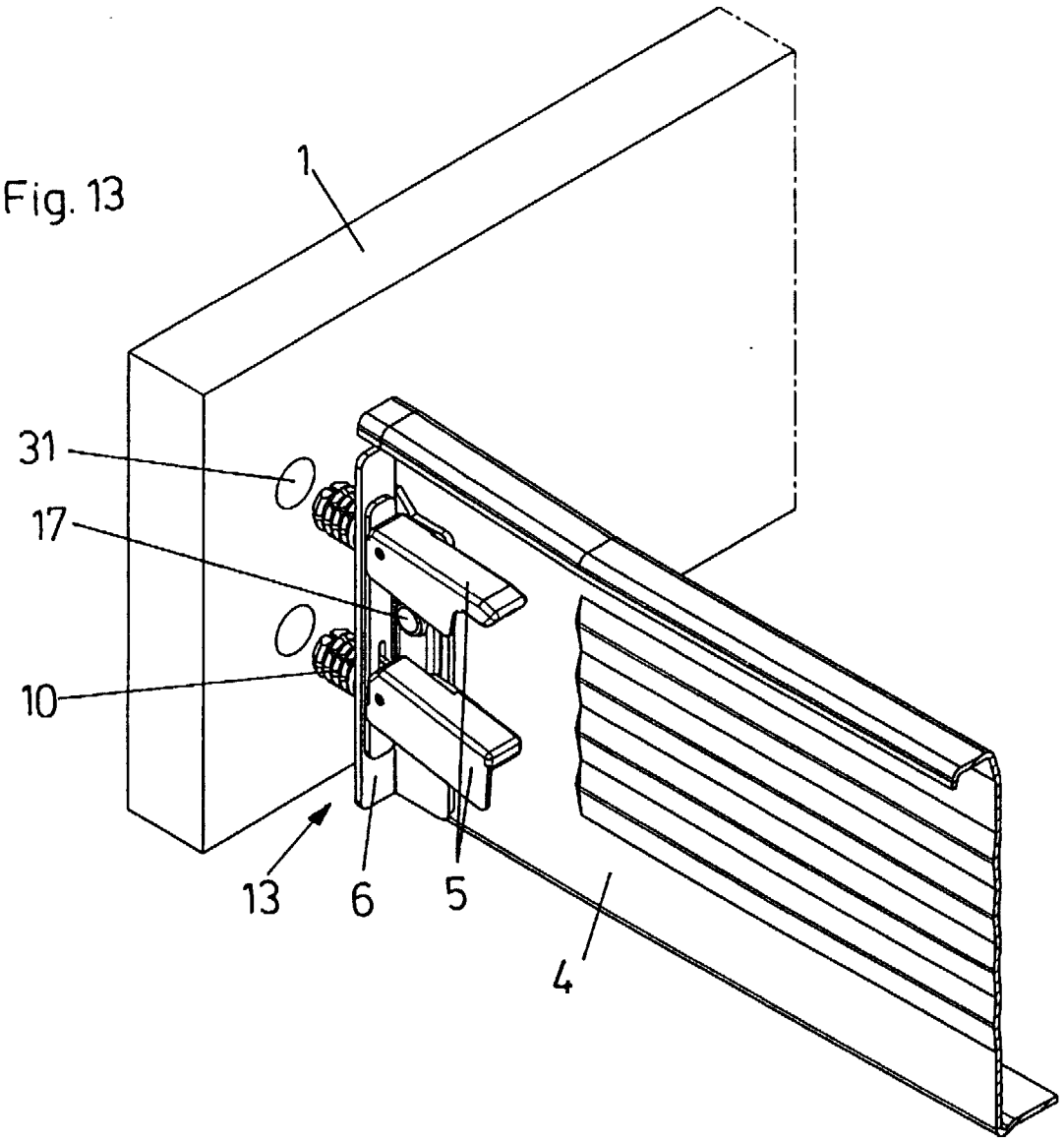
FIG. 13 is a perspective view of the same embodiment but with the fastening device shown in a released position.
Figure 14:
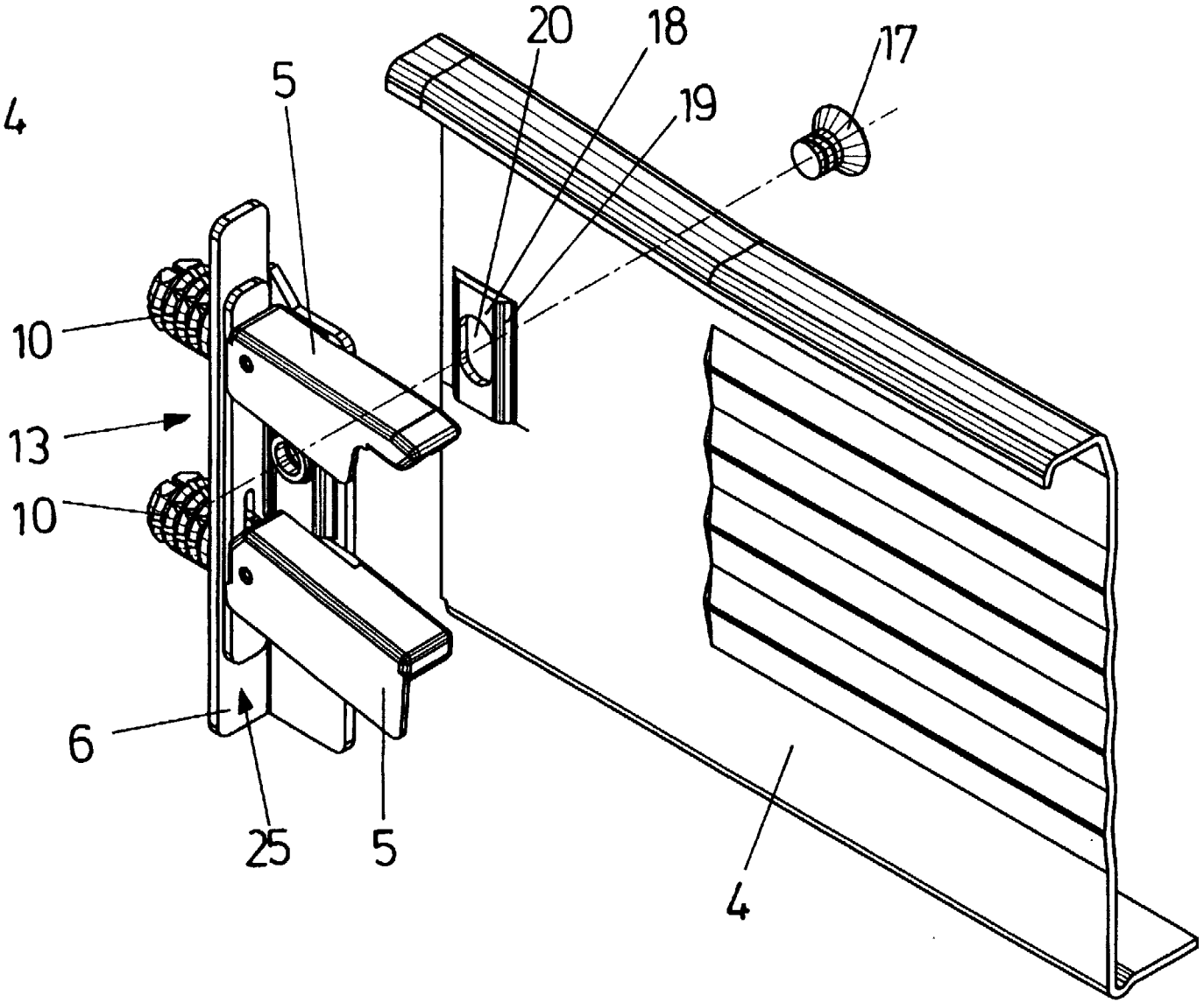
FIG. 14 is a perspective view of the fastening device in the released position and a perspective view of the front end of the drawer side wall.
Figure 15:
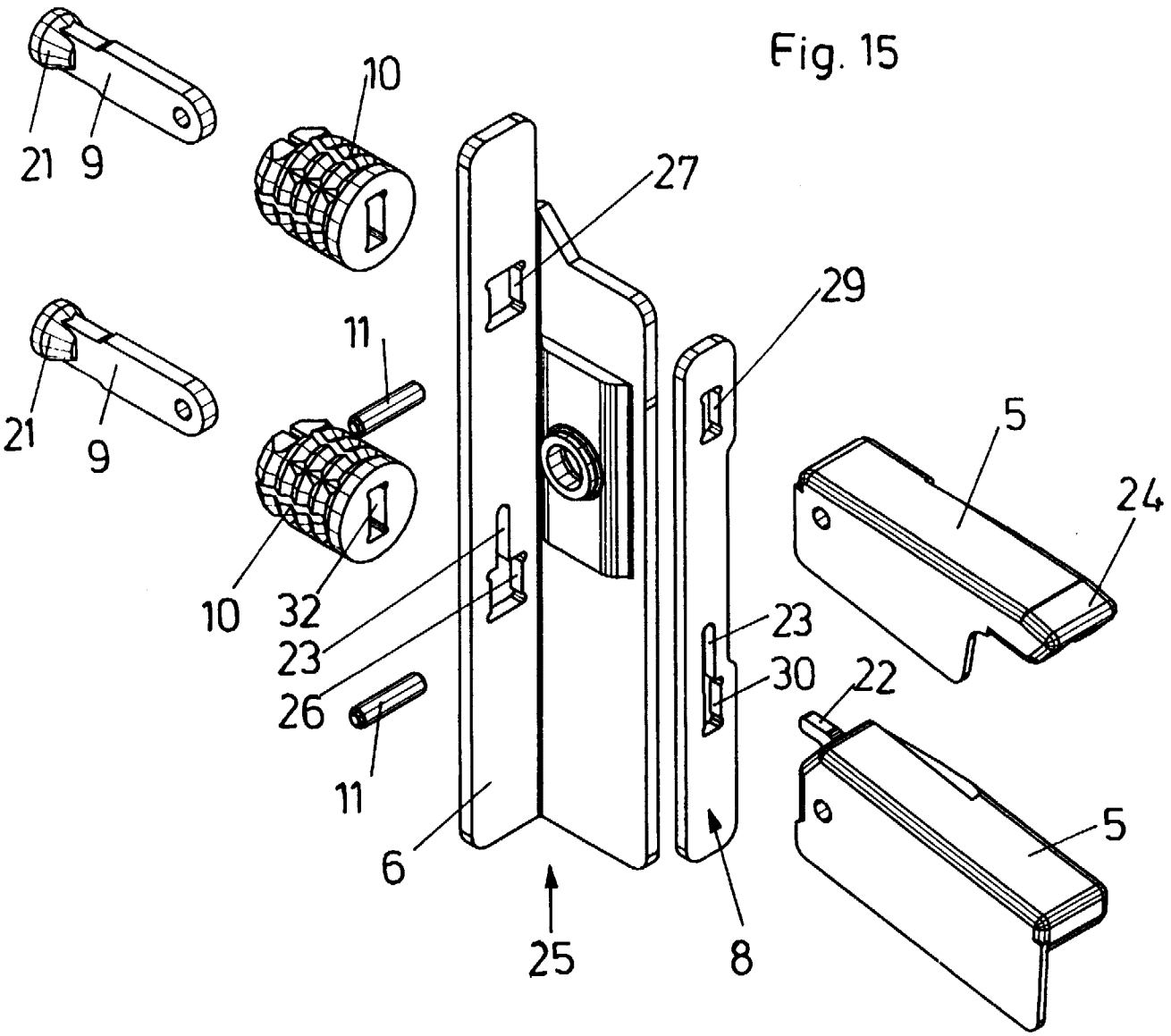
FIG. 15 is an exploded perspective view of the fastening device.
Figure 16:
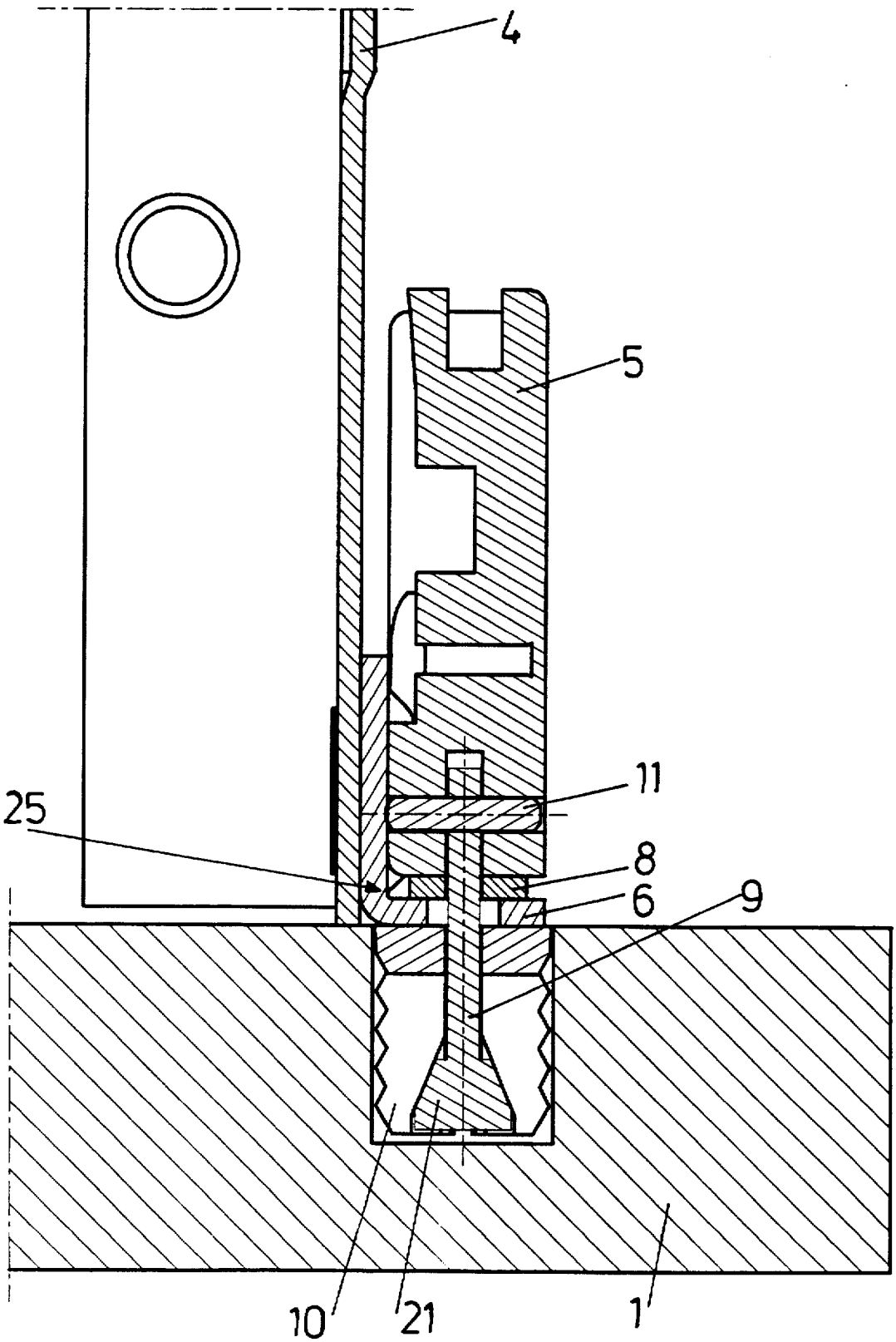
FIG. 16 is a horizontal sectional view of the fastening device with the front plate being mounted but not clamped.
Figure 17:
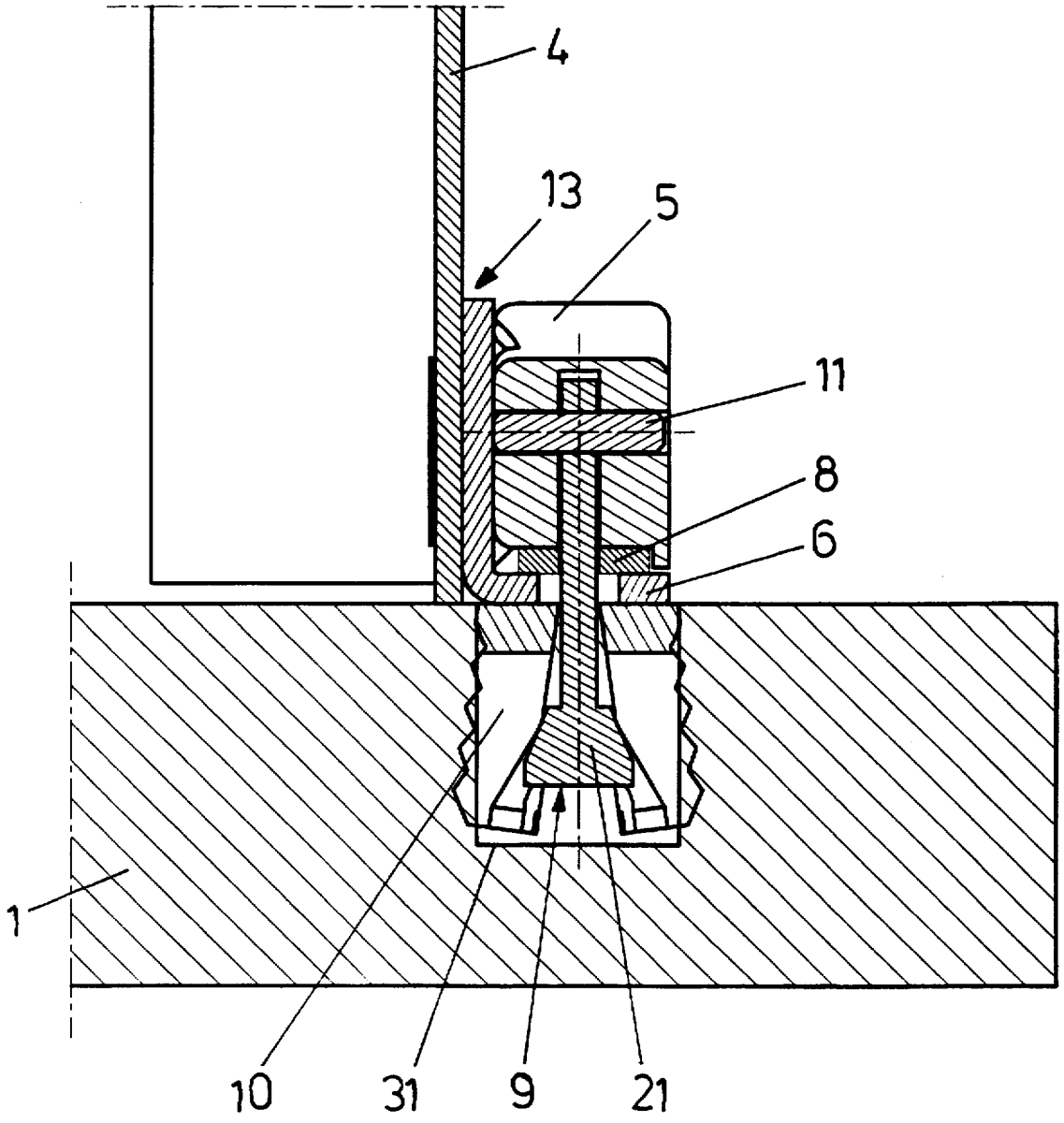
FIG. 17 is the same horizontal sectional view but with the front plate clamped.

As shown in FIG. 9, the expanding member 9 is held in the keyhole form slot 14 without clearance when the tensioning lever 5 is in the released position. If the tensioning lever 5 is tightened so that it is brought to the position shown in FIG. 10, the reduction 12 is in the area of the keyhole slot 14 and lateral displacement of the front plate 1 is possible. In the subsequent tightened position which is shown in FIG. 11, the dowel 10 is held immovably at the flange 6 by the clamping force of the tensioning lever 5.

In the embodiment of FIGS. 12 to 16 the flanges 6 are not formed on the drawer side walls 4 but are parts of separate angled brackets 25. The angled brackets 25 are fastened to the drawer side walls 4 by means of clamping screws 17. The clamping screws 17 of each fastening device 13 rest in female threads in the angled brackets 25 and extend through a slot 20 in the drawer side wall 4. In the area of the slot 20 the drawer side wall 4 is provided with lateral bulges 18 which have lateral wedge surfaces 19. A corresponding bulge on the angled bracket 25 provides a tilt-free hold of the angled bracket 25 on the drawer side wall 4 by abutting the bulge 18 and the wedge surfaces 19 of the drawer side wall 4 with corresponding wedge surfaces.

In this embodiment each fastening device 13 includes two tensioning levers 5. The tensioning levers 5 are arranged one above the other and are tiltable about respective horizontal axles 11. The axles 11 connect the tensioning levers 5 with respective expanding members 9. Each expanding member 9 is provided with a truncated conical head 21 which activates expansion of the dowel 10 when the expanding members 9 are tightened.

Between the tensioning levers 5 and the respective flange 6 is situated an intermediate plate 8, preferably of metal. Each flange 6 is provided with openings 26, 27 through which extend the expanding members 9. Above the conical end 21 each expanding member 9 is constructed with a rectangular cross section of a dimension less than that of respective opening 26, 27 in the flange 6. The intermediate plate 8 is provided with openings 29, 30 which correspond with the openings 26, 27 in the flange 6 and through which extend the expanding members. The openings 29, 30 are narrower than the openings 26, 27 in the flange 6 and correspond approximately to the width of the expanding members 9.

Vertical slots 23 border and extend upwardly from the lower openings 26, 30. The lower tensioning lever 5 is provided with a projection 22 which, when the tensioning lever 5 is in the non-locking position shown in FIG. 14, projects into the slots 23 in plate 8 and flange 6 and acts as a lateral positioning means for the front plate 1 with respect to the drawer side wall 4. If the lower tensioning lever 5 is tilted downwardly or upwardly the projection 25 is moved out of the slot 23 and the front plate 1 is laterally displaceable with respect to the drawer side wall 4. The free end of upper tensioning lever 5 is provided with cap 24 which in the locking (shown in FIG. 12) covers the projection 22 of the lower tension lever 5.

The embodiment has the advantage that less force has to be used for bracing the front plate 1, whereby a secure hold for the front plate on the drawer side wall 4 is guaranteed. As in the previous embodiment, the dowels 10 extend into drill holes 31 in the front plate 1. In this embodiment, the dowels 10 are provided with rectangular passages 32 which correspond to the rectangular cross section of the expanding members 9.

I claim:

1. A fastening device for fastening a front plate of a drawer to a drawer side wall, said device comprising:

a flange having a first side to be directed toward the front plate and a second side to be directed away from the front plate;

at least one expandable dowel to be inserted into a hole in the front plate, said dowel being separate from and not integral with said flange;

an expanding member positioned within said dowel and movable therein between an expanding position and a release position, said expanding member having an end extending from said dowel;

said dowel and said expanding member being positioned at said first side of said flange with said end of said expanding member passing through an aperture in said flange;

at least one tensioning lever positioned at said second side of said flange and pivotally connected to said end of said expanding member for pivoting movement between a released position and a tensioning position; and said tensioning lever having a cam operable to act on said flange, when said tensioning lever is pivoted to said tensioning position, to pull said expanding member relative to said dowel to expand said dowel outwardly and to clamp said flange between said dowel and said cam.

2. A device as claimed in claim 1, wherein said flange is formed integrally with a front end of the drawer side wall and extends transversely therefrom.

3. A device as claimed in claim 1, wherein said flange is part of an angled bracket that is connectable to the drawer side wall.

4. A device as claimed in claim 3, wherein said angled bracket has therein at least one threaded hole for receipt of a bolt for connecting said angled bracket to the drawer side wall.

5. A device as claimed in claim 3, wherein said angled bracket has at least one wedge surface to abut a corresponding wedge surface of the drawer side wall.

6. A device as claimed in claim 1, comprising two dowels and two expanding members, each said expanding member being positioned within a respective said dowel, and each said expanding member having a respective end passing through a respective said aperture in said flange.

7. A device as claimed in claim 6, comprising a single said tensioning lever pivotally connected to both said expanding members.

8. A device as claimed in claim 7, wherein said tensioning lever has a projection extending from a pivoted end thereof.

9. A device as claimed in claim 8, wherein said projection extends into a hole in said flange when said tensioning lever is in said released position.

10. A device as claimed in claim 9, wherein said hole is located between said apertures.

11. A device as claimed in claim 8, further comprising an intermediate plate positioned between said flange and said tensioning lever.

12. A device as claimed in claim 11, wherein said projection extends into a hole in said intermediate plate when said tensioning lever is in said released position.

13. A device as claimed in claim 6, comprising two said tensioning levers, each said tensioning lever being pivotally connected to a respective said dowel.

14. A device as claimed in claim 13, wherein one said tensioning lever has a projection extending from a pivoted end thereof.

15. A device as claimed in claim 14, wherein said flange has therein a slot, and said projection extends into said slot when said tensioning lever is in said released position.

16. A device as claimed in claim 15, wherein said projection fits in said slot with substantially no clearance.

17. A device as claimed in claim 15, further comprising an intermediate plate positioned between said flange and said one tensioning lever.

18. A device as claimed in claim 17, wherein said projection extends into a slot in said intermediate plate when said one tensioning lever is in said released position.

19. A device as claimed in claim 18, wherein said expanding members extend through respective apertures in said flange and in said intermediate plate.

20. A device as claimed in claim 19, wherein said apertures in said intermediate plate are narrower than said apertures in said flange.

21. A device as claimed in claim 19, wherein said slots in said flange and in said intermediate plate extend from respective said apertures.

22. A device as claimed in claim 13, wherein said two tensioning levers are spaced vertically and are pivoted about respective horizontal axes.

23. A device as claimed in claim 22, wherein said one tensioning lever comprises a lower tensioning lever, and an upper tensioning lever has a cap covering said projection when said two tensioning levers are in respective tensioning positions thereof.

24. A device as claimed in claim 1, further comprising an intermediate plate positioned between said flange and said tensioning lever, said expanding member extending through a hole in said intermediate plate.

25. A device as claimed in claim 1, wherein said tensioning lever extends parallel to said flange when in said released position and extends transverse to said flange when in said tensioning position.

26. A device as claimed in claim 1, wherein said tensioning lever extends transverse to said flange when in said released position and extends parallel to said flange when in said tensioning position.

27. A device as claimed in claim 1, wherein said aperture has a keyhole shape.

28. A device as claimed in claim 27, wherein said keyhole-shaped aperture includes an enlarged portion of a size through which is fittable said dowel.

29. A device as claimed in claim 28, wherein said dowel has an annular groove into which fit edges of said flange that define a reduced size portion of said keyhole-shaped aperture.

30. A device as claimed in claim 1, wherein said end of said expanding member includes an enlarged size portion and an adjacent reduced size portion, when said tensioning lever is in said released position said enlarged size portion fits in a rim of said aperture without clearance therebetween, and when said tensioning lever is in said tensioning position said reduced size portion fits in said rim of said aperture with clearance therebetween.

* * * * *